US007952055B2

(12) United States Patent
Turner et al.

(10) Patent No.: US 7,952,055 B2
(45) Date of Patent: May 31, 2011

(54) METHODS AND APPARATUS FOR DEPLOYING CONTROL SURFACES SEQUENTIALLY

(75) Inventors: Damon C. Turner, Tucson, AZ (US); Robert W. Martin, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 569 days.

(21) Appl. No.: 11/943,821

(22) Filed: Nov. 21, 2007

(65) Prior Publication Data

US 2009/0127378 A1 May 21, 2009

(51) Int. Cl.
*F42B 10/14* (2006.01)

(52) U.S. Cl. ..... 244/3.28

(58) Field of Classification Search ..... 102/382; 244/3.24, 3.27–3.29

See application file for complete search history.

(56) References Cited

U.S. PATENT DOCUMENTS

| | | | | |
|---|---|---|---|---|
| 4,175,720 | A | 11/1979 | Craig | |
| 4,296,895 | A * | 10/1981 | Pazmany | 244/3.29 |
| 6,073,880 | A * | 6/2000 | Voigt et al. | 244/3.28 |
| 6,502,785 | B1 | 1/2003 | Teter et al. | |
| 7,004,424 | B1 * | 2/2006 | Pacchia | 244/3.27 |
| 7,175,131 | B2 | 2/2007 | Dodu et al. | |
| 2008/0111020 | A1 * | 5/2008 | Peterson | 244/3.28 |

* cited by examiner

*Primary Examiner* — Joshua J Michener
*Assistant Examiner* — Brian M O'Hara
(74) *Attorney, Agent, or Firm* — Ingrassia Fisher & Lorenz, P.C.

(57) ABSTRACT

Methods and apparatus for deploying control surfaces generally comprise a fin deployment system for projectiles. The fin deployment system is used to control the timing of the control surface deployment. In one embodiment, the deployment system comprises a clip that is configured to react the biasing force of one control surface against another in order to maintain the control surfaces in a non-deployed state until at least one control surface is able to overcome the retention force of the clip, thus beginning a chain reaction in which all of the control surfaces deploy sequentially.

10 Claims, 6 Drawing Sheets

METHODS AND APPARATUS FOR DEPLOYING CONTROL SURFACES SEQUENTIALLY

BACKGROUND OF INVENTION

Various surfaces are used to facilitate control of a craft's direction while in flight. The ability to control flight characteristics produces a stable flight path and permits controlled guidance of the craft. Flight controls typically include ailerons, an elevator, and a rudder. Flight controls in projectiles may be as simple as comprising a set of tail fins in order to maintain stable flight along a desired path.

Many projectiles are fired or launched through a tube or barrel necessitating the need for any control surfaces to not impede the projectile's path. In order to accommodate this requirement, projectiles will often utilize deployable control surfaces that extend outwards from the projectile after launch. It is necessary to control when these surfaces are extended otherwise the control surfaces could cause damage to neighboring structures during launch.

SUMMARY OF THE INVENTION

Methods and apparatus for deploying control surfaces according to various aspects of the present invention comprise a plurality of control surfaces and a retaining system for selectively retaining the control surfaces. The retaining system is configured to hold the control surfaces in a nondeployed state until a specified event or conditions occurs.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described herein in terms of functional block components and various processing steps. Such functional blocks may be realized by any number of hardware or software components configured to perform the specified functions and achieve the various results. For example, the present invention may employ various sensors, restraints, biasers, control surfaces, and the like, which may carry out a variety of functions. In addition, the present invention may be practiced in conjunction with any number of craft or deployable systems, and the system described is merely one exemplary application for the invention. Further, the present invention may employ any number of conventional techniques for sensing movement, restraining elements, deploying elements, and the like.

Figure 1:
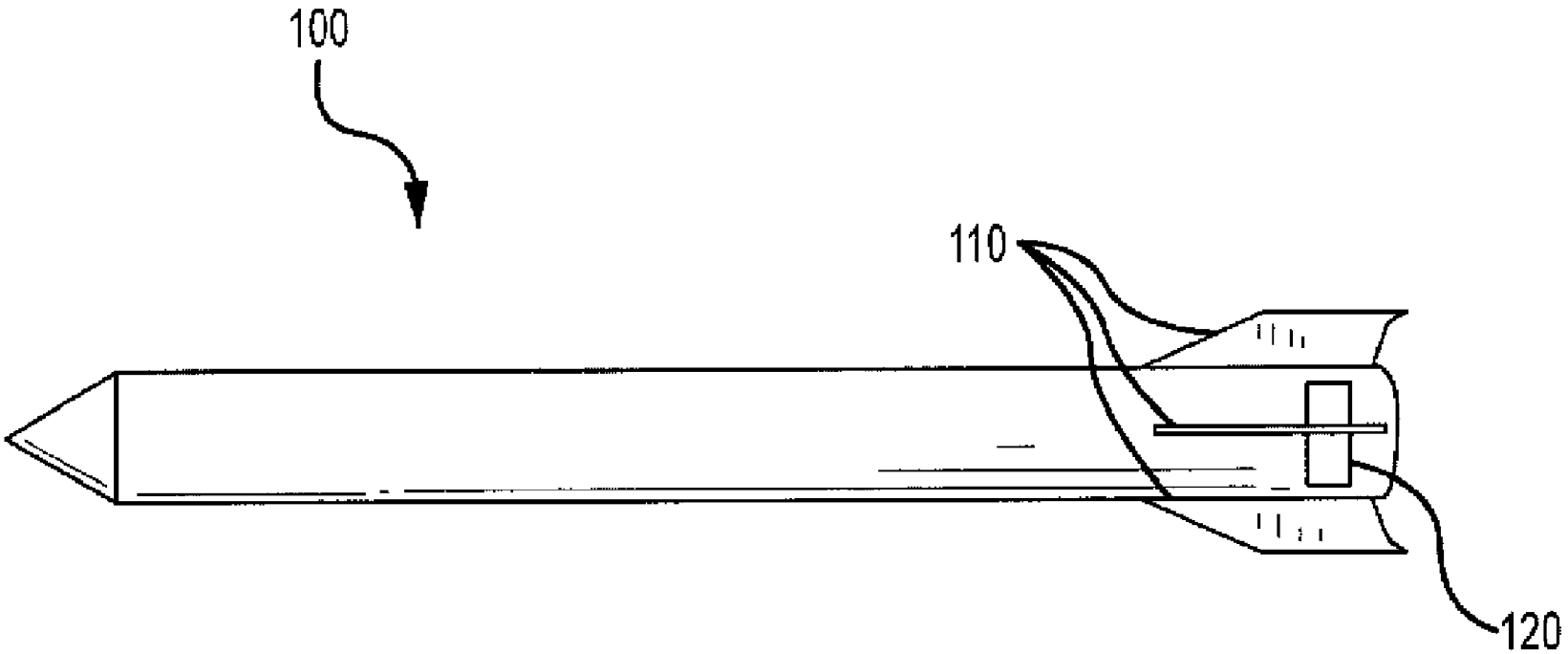
FIG. 1 representatively illustrates a projectile in accordance with an exemplary embodiment of the present invention.

Various representative implementations of the present invention may be applied to any system for deploying movable elements. Certain representative implementations may include, for example, control surfaces, biasers, restraints, sensors, and release mechanisms. Referring now to FIG. 1, methods and apparatus for deploying control surfaces according to various aspects of the present invention may operate in conjunction with a projectile 100 having deployable elements, such as a missile or rocket having deployable fins 110. The projectile 100 includes a deployment system 120 to move the deployable fins 110 between deployed and nondeployed positions.

The projectile 100 comprises a moving system, for example to deliver a payload. The projectile 100 may comprise any system having deployable elements, such as a missile, rocket, guided bomb, aircraft, or torpedo. In the present embodiment, die projectile comprises a guided rocket. The projectile 100 includes deployable fins 110, which are deployed by the deployment system 120. For example, the deployment system 120 may deploy the deployable fins 110 at a selected time or event following launch of the guided rocket. The deployment system 120 may, however, be configured to deploy the deployable fins 110 or other deployable elements in any appropriate manner.

Figure 2A:
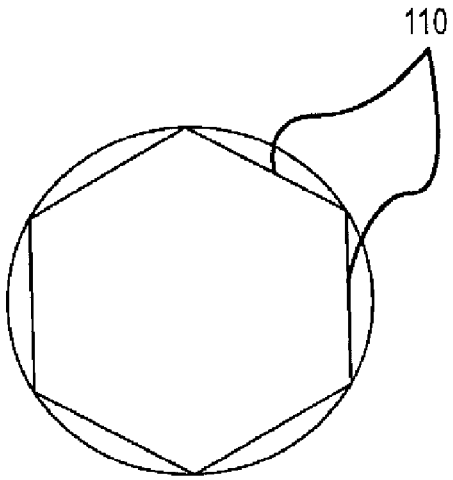
FIG. 2A representatively illustrates a rear view of a projectile with a plurality of deployable fins in the nondeployed condition in accordance with an exemplary embodiment of the present invention.
Figure 2B:
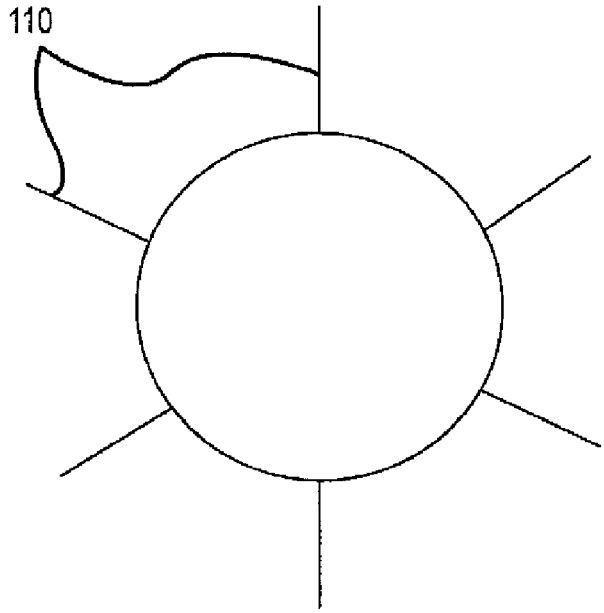
FIG. 2B representatively illustrates a rear view of a projectile with a plurality of deployable fins in the deployed condition in accordance with an exemplary embodiment of the present invention.

The deployable fins 110 move between physical positions. The deployable fins 110 may comprise any deployable elements associated with the projectile 100, such as control surfaces, sensor vanes, or propulsion systems. In the present embodiment, the deployable elements comprise fins, such as tail fins, canards, wings, stabilators, and the like. In particular, the present rocket deploys a set of tail fins. The tail fins are deployable between a nondeployed position and a deployed position in response to the deployment system 120. For example, referring to FIG. 2A, in a nondeployed position, the deployable fins 110 may be folded to be substantially flat against a main body of the projectile 100. Referring now to FIG. 2B, in a deployed position, the deployable fins 110 may move to extend to a position substantially perpendicular to the main body of the projectile 100. The deployed and nondeployed positions may, however, comprise any appropriate positions for the deployable fins 110 or other deployable elements.

Figure 3:
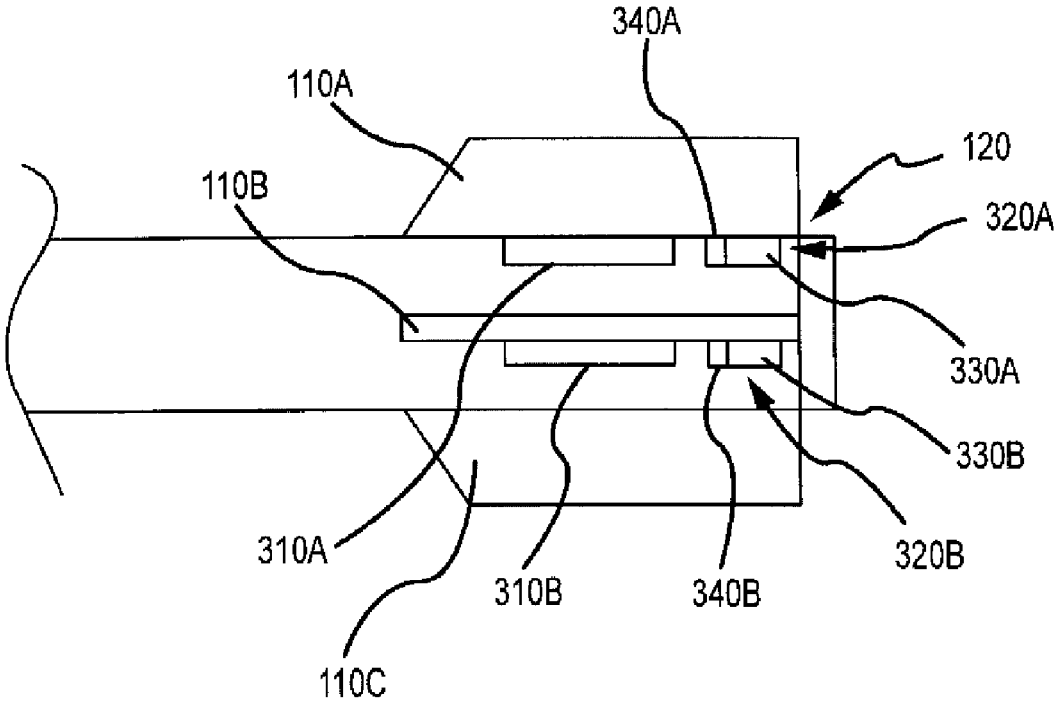
FIG. 3 representatively illustrates the elements of the deployment system in accordance with an exemplary embodiment of the present invention.

The deployment system 120 controls the movement of the deployable elements between the deployed and nondeployed positions. The deployment system 120 may comprise any system for controlling deployment, such as actuators, springs, retainers, and sensors. Referring to FIG. 3, in the present embodiment, the deployment system 120 comprises a plurality of biasers 310 and a plurality of retainers 320 affixed to each deployable fin 110. Each biaser 310 biases a deployable fin 110 to move the deployable fin 110 from the nondeployed position to the deployed position. Each retainer 320 retains a deployable fin 110 in position until a selected time or event, at which point a first retainer 320A releases a first deployable fin 110A.

Figure 4:
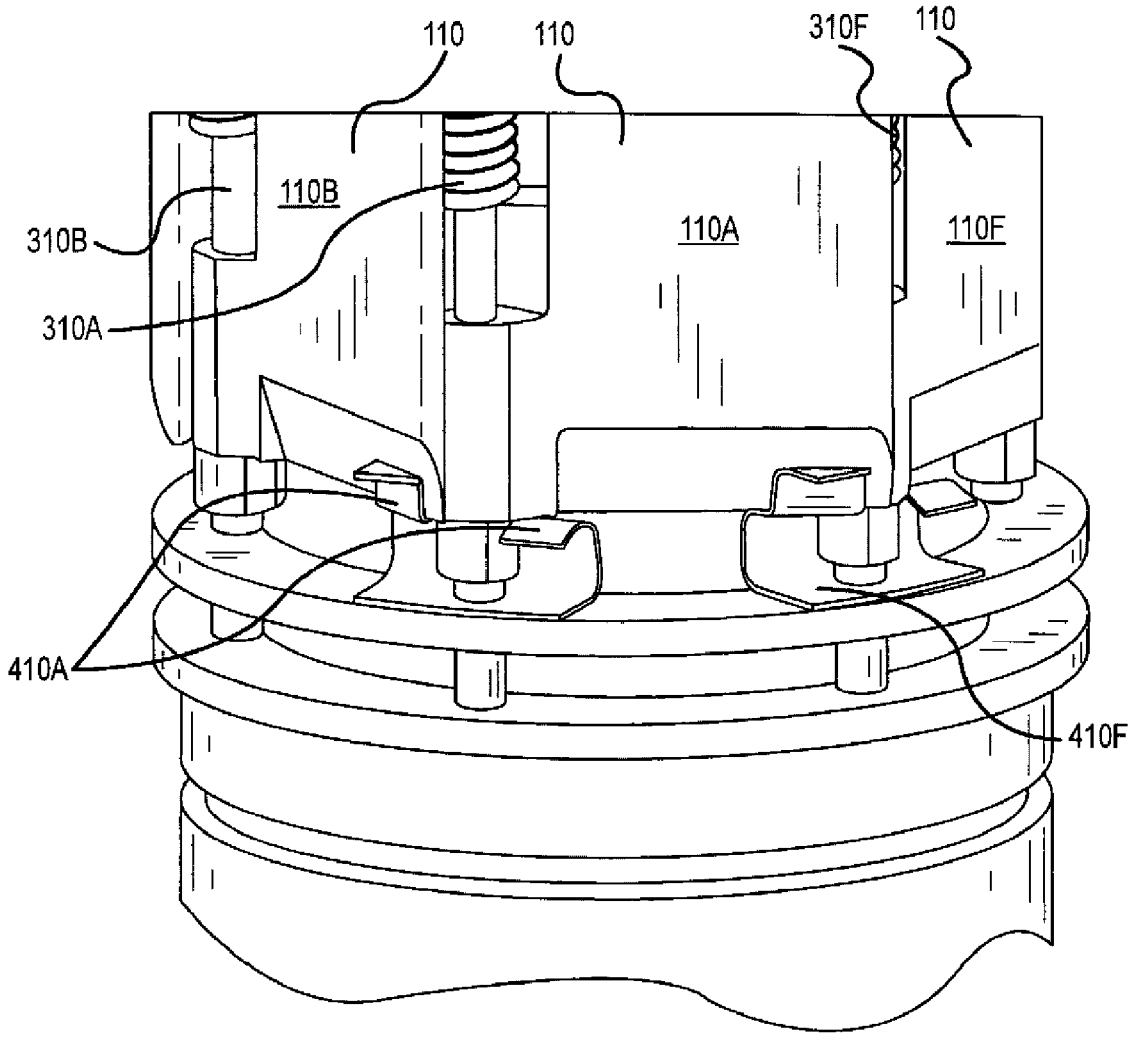
FIG. 4 representatively illustrates the retaining system that prevents the deployable fins from moving from the nondeployed position to the deployed position in accordance with an exemplary embodiment of the present invention.

For example, the biaser 310 may apply a force to the deployable fins 110 to move the deployable fins 110 from the nondeployed position to the deployed position. The biaser 310 may comprise any system for moving the deployable fins 110, such as a spring, motor, actuator, and the like. In the present embodiment, the biaser 310 comprises a spring disposed to apply a force between the body and the deployable fins 110 and configured to bias the deployable fins 110 towards the perpendicular position. Referring to FIGS. 3 and 4, the present biaser 310 comprises a conventional coil spring having a first leg engaging one of the deployable fins 110 and a second leg engaging the body of the projectile 100. The biaser 310 may, however, be configured in any manner to apply a force to the deployable fins 110 for deployment.

The retainer 320 selectively retains the deployable fins 110 in position against the force of the biaser 310. The retainer 320 may comprise any system for selectively retaining and releasing the deployable fins 110, such as an actuator, motor, movable restraint, and the like. For example, the present retainer 320 may release the deployable fin 110 in response to one or more predetermined events, such as achieving a predetermined roll rate and/or release of an adjacent fin. The retainer 320 may be configured, however, to deploy the deployable fins 110 in response to any appropriate criterion, time, or event Referring to FIGS. 3 and 4, in the present embodiment, the retainer 320 engages a first deployable fin 110 to be retained and responds to movement of an adjacent deployable fin 110. The retainer 320 may also release the deployable fin 110 in response to a predetermined force applied by the deployable fin 110, such as a predetermined centrifugal force generated by a certain roll rate added to the force applied by the biaser 310.

In one embodiment, the retainer 320 comprises a restraint 330 and a sensor 340. The sensor 340 senses a time, condition, or event for deploying the deployable element. The restraint 330 restrains the deployable fin 110 against the body or otherwise holds a deployable fin 110 in position until the sensor 340 indicates that the deployable fin 110 should be deployed.

Figure 5:
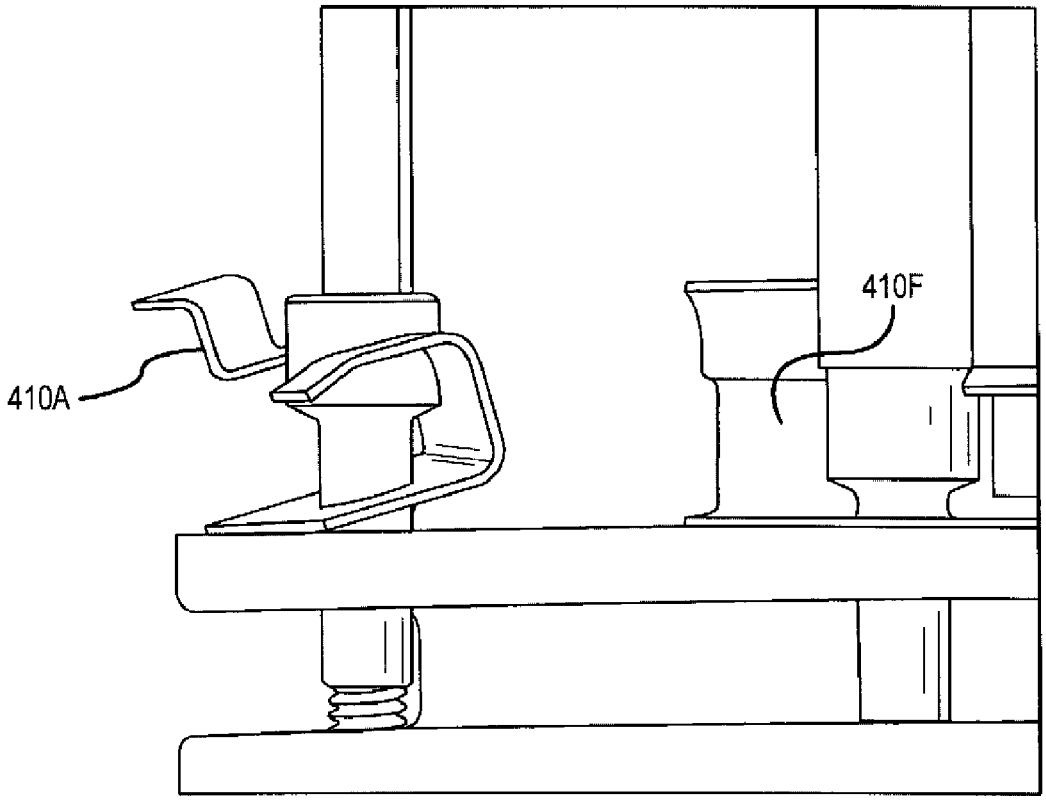
FIG. 5 representatively illustrates the reaction of the retaining clip after a deployable fin has moved to the deployed position in accordance with an exemplary embodiment of the present invention.

The restraint 330 may comprise any system or component for restraining the deployable fin 110 in position, such as a pin, clip, cable, sliding bolt, electromagnet, or the like. In the present embodiment, the restraint 330 is configured to restrain the deployable fin 110 against the body. For example, referring to FIG. 4, the restraint 330 may comprise a clip 410A configured to engage the deployable fin 110B to the body. In particular, the clip 410A may include a surface that engages an outer surface of deployable fin 110B to inhibit movement to the deployed position while also engaging a second deployable fin 110A. The clip 410A comprises a resilient material, such as a metal or plastic, which may bend in response to a selected force. Referring now to FIGS. 4 and 5, the present clip 410A is configured to initially react the biasing force of deployable fin 110B to a second deployable fin 110A in order to maintain a nondeployed state.

The clip 410A is further configured to substantially bend away from the body when the deployable fin 110B applies a selected force to the clip. When the clip 410A bends enough in response to a preselected force, the deployable fins 110B escapes the clip 410A and moves into a deployed position. Referring to FIG. 5, additionally, once a first deployable fin 110A is moved to a deployed position it no longer provides the necessary reaction force to the clip 410A and a second deployable fin 110B moves to a deployed position. This chain reaction continues sequentially until each deployable fin 110 is deployed.

The sensor may comprise any system or component capable of sensing a desired condition such as rotational speed, time, or force. In the present embodiment, the sensor 340 is configured to sense to a force applied by a deployable fin 110. In addition, the present sensor 340 is coupled to the clip 410. The clip 410 senses the force applied by one of the deployable fins 110 and maintains the deployable fin 110 in a nondeployed state until the total force applied to the clip by the deployable fin 110 exceeds the amount of force the clip 410 is designed to maintain.

Figure 6:
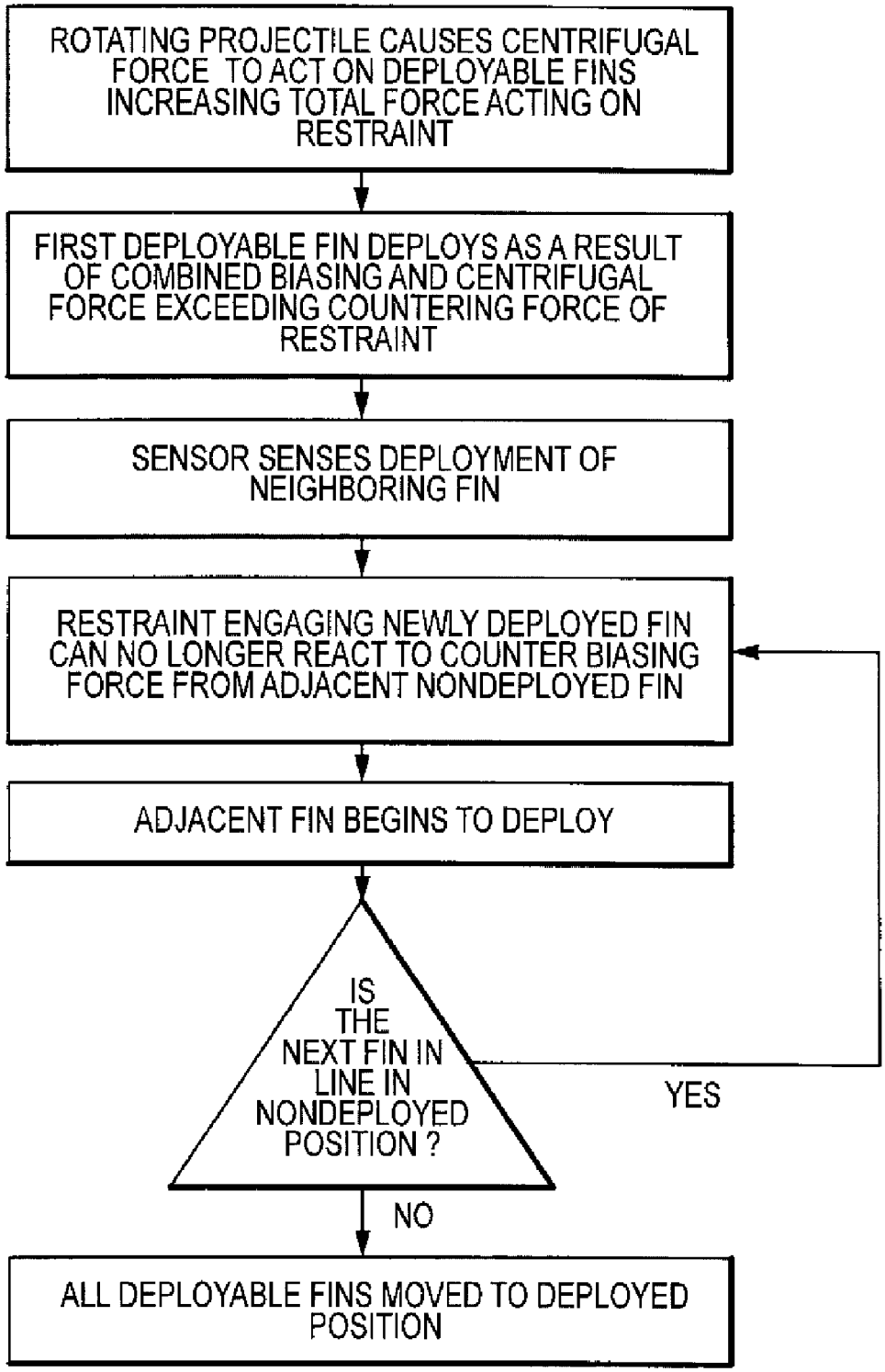
FIG. 6 is a block diagram representatively illustrating the deployment system in accordance with an exemplary embodiment of the present invention.

The deployable fins 110 are maintained in a nondeployed position by the plurality of retainers 320. In the present embodiment, the deployment system 120 is configured to first sense and release a first deployable fin 110A in response to a condition or event and secondly, to sense the movement of the first deployable fin 110 and then release a second deployable fin 10B which is coupled to the first deployable fin 110A through a clip 410A. Referring now to FIG. 6, the first deployable fin 110 moves to a deployed position when the total force of the biaser 310 and the centrifugal force imparted from the spinning motion of the projectile 100 overcome the retaining force of the restraint 330.

As the first deployable fin 110 begins to move to a deployed position, the sensor 340 which is coupled to the restraint 330 senses the movement of the deployable fin 110 and responds by allowing the second deployable fin to begin moving to a deployed position. This process is repeated and each deployable fin 110 is allowed to move in succession to a deployed position until all of the deployable fins 110 are deployed.

In operation, a projectile 100 is fired at a target and a guidance system activates in order to increase the probability of a successful strike. The projectile may comprise any suitable manner of guidance including the use of control surfaces, propulsion systems, or other navigations systems to increase accuracy. In the present embodiment, the guidance system comprises a set of deployable fins 110 which are released after firing. The deployment of the deployable fins 110 is delayed for a period of time such that the projectile 100 is allowed to clear any obstructions, such as other projectiles which have not been fired, before the deployable fins 110 move to the deployed position.

When the projectile 100 is fired or launched, a rotation is imparted on the projectile 100 by the barrel, launch tube, or projectile propulsion system. The deployable fins 110 are kept in a nondeployed position during firing due to a plurality of restraints 330 that resist a force applied by a plurality of biasers 310 on the deployable fins 110 by reacting that force to an adjacent deployable fin 110. As the projectile 100 accelerates forward, the rotational velocity of the projectile also accelerates. This acceleration results in a centrifugal force which acts on the deployable fins 110 increasing the total force acting on the restraints 330.

When the total force acting on a restraint 330A is great enough, a first deployable fin 110A moves past the restraint 330A to a deployed position that is substantially perpendicular to the body of the projectile 100. After the first deployable fin 110A has overcome the restraint 330A, an adjacent deployable fin 110B begins to move to a deployed state because a second restraint 330B can no longer react the force applied by the second deployable fin 110B against the first deployable fin 110A. This series of event continues until all of the deployable fins 110 have moved to a deployed position.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A fin deployment system for deploying a first fin in response to movement of a second fin, comprising:

a biaser configured to apply a biasing force to the first fin; and a bendable retainer affixed to the first fin, wherein the retainer comprises:

an engaging portion configured to engage the second fin and to bend the retainer in response to movement of the second fin; and a restraint configured to inhibit movement of the first fin in opposition to the biasing force until the retainer is bent.

2. A fin deployment system according to claim 1, wherein the restraint is configured to deploy the first fin when a predetermined force is applied to the restraint.

3. A fin deployment system according to claim 2, wherein the predetermined force is a centrifugal force applied to the restraint by the fin.

4. A fin deployment system according to claim 1, wherein the engaging portion comprises a mechanical member of the retainer that engages the second fin.

5. A fin deployment system according to claim 4, wherein the retainer is a clip that deforms in response to movement of the mechanical member.

6. A fin deployment system according to claim 4 wherein the retainer is formed of a resilient material that bends in response to movement of the mechanical member.

7. A fin deployment system according to claim 1, wherein:

the engaging portion comprises a member abutting the second fin, wherein the second fin holds the member in position before the second fin has moved.

8. A fin deployment system for deploying a plurality of fins, the system comprising:

a plurality of biasers, each biaser associated with one of the plurality of fins and configured to apply a biasing force to the associated fin; and a plurality of deformable retainers, each retainer associated with one of the plurality of fins, wherein each of the plurality of retainers comprises:

a restraining portion configured to retain the associated fin in a non-deployed position in opposition to the biasing force applied by the biaser; and an engaging portion configured to mechanically engage another of the plurality of fins and to deform the restraining portion of the retainer in response to movement of the other fin, thereby allowing the biasing force to move the associated fin from the non-deployed position to a deployed position.

9. The fin deployment system of claim 8 wherein each of the plurality of retainer clips comprises a connector that transmits force applied by the engaging portion to the restraining portion.

10. The fin deployment system of claim 8 wherein each of the retainers is formed of a resilient material that bends in response to movement of the engaging portion.

* * * * *